United States Patent [19]

Ram et al.

[11] 3,954,950

[45] *May 4, 1976

[54] PRODUCTION OF HIGH TENACITY GRAPHITIC FIBROUS MATERIALS

[75] Inventors: Michael J. Ram, West Orange; Arnold J. Rosenthal, Whippany, both of N.J.; Charles M. Clarke, Texas City, Tex.

[73] Assignee: Celanese Corporation, New York, N.Y.

[ * ] Notice: The portion of the term of this patent subsequent to Dec. 11, 1990, has been disclaimed.

[22] Filed: Apr. 25, 1973

[21] Appl. No.: 354,469

Related U.S. Application Data

[62] Division of Ser. No. 17,832, March 9, 1970, Pat. No. 3,775,520.

[52] U.S. Cl. ..... 423/447; 264/29

[51] Int. Cl.[2] ..... C01B 31/07

[58] Field of Search ..... 423/447; 264/182, 29

[56] References Cited

UNITED STATES PATENTS

| | | | |
|---|---|---|---|
| 3,539,295 | 11/1970 | Ram | 423/447 |
| 3,647,770 | 3/1972 | Gump et al. | 264/236 |
| 3,677,705 | 7/1972 | Ram et al. | 423/447 |
| 3,708,326 | 1/1973 | Chenexey et al. | 117/136 |
| 3,708,326 | 1/1973 | Chenexey et al. | 117/137 |
| 3,729,549 | 4/1973 | Gump et al. | 423/447 |
| 3,775,520 | 11/1973 | Ram et al. | 264/29 |
| 3,841,079 | 10/1974 | Ram et al. | 57/140 R |

FOREIGN PATENTS OR APPLICATIONS

| | | | |
|---|---|---|---|
| 39-14032 | 7/1964 | Japan | 264/182 |

*Primary Examiner*—Jay H. Woo

[57] ABSTRACT

A process is provided for the efficient conversion of acrylonitrile homopolymer fibrous materials and closely related acrylonitrile copolymer fibrous materials to graphitic fibrous materials of high tenacity. The process incorporates an initial brief fiber healing step which is conducted at a temperature of about 170° to 220°C., a preoxidation step, and a tandem carbonization/graphitization step as described. The relationship of the various variables required to produce the high tenacity graphitic fibrous product is set forth in the equation provided. In a preferred embodiment of the invention the carbonization/graphitization step of the process is conducted on a reliable and stable basis wherein the desired tenacity is achieved without the necessity of resorting to the exertion of high longitudinal tensions upon the preoxidized acrylic fibrous material.

12 Claims, 2 Drawing Figures

PRODUCTION OF HIGH TENACITY GRAPHITIC FIBROUS MATERIALS

This is a division of application Ser. No. 17,832, filed Mar. 9, 1970 now U.S. Pat. No. 3,775,520.

BACKGROUND OF THE INVENTION

In the past procedures have been proposed for converting an acrylic fibrous precursor to an amorphous carbon form or to a graphitic carbon form which retains essentially the same fibrous configuration as the starting material. The acrylic fibrous material is first thermally stabilized, and then carbonized.

The thermal stabilization of an acrylic fibrous material in an oxygen-containing atmosphere is well known in the art and involves (1) an oxidative cross-linking reaction of adjoining molecules as well as (2) a cyclization reaction of pendant nitrile groups to a condensed dihydropyridine structure. The cyclization reaction is exothermic in nature and must be controlled if the fibrous configuration of the acrylic material is to be preserved. Accordingly, stabilization procedures commonly proposed are conducted for many hours (e.g. at 220°C. for 3 to 7 hours, or more). During the carbonization reaction elements in the stabilized fibrous material other than carbon, e.g. nitrogen, hydrogen, and oxygen are expelled. The term "carbonized fibrous material" as used herein is defined to be a material consisting of at least about 90 per cent carbon by weight, and preferably at least about 95 per cent carbon by weight. Depending upon the conditions under which the carbonized fibrous product is processed, substantial amounts of graphitic carbon may or may not be present in the same as determined by the characteristic x-ray diffraction pattern of graphite.

The achievement of uniformly superior mechanical properties in carbon fibers, such as tensile strength and initial modulus, has been an elusive goal when employing processes of the prior art. For instance, heretofore, it has been proposed that high longitudinal tensional forces be exerted upon a carbonaceous fibrous material during the formation of graphitic carbon. Unfortunately, such processes which operate under high tensions tend to be unstable and have a tendency to fail because of fiber breakage which may be traced at least in part to incipient flaws or voids present in the fibrous material. For a reliable commercial operation, such process failures cannot be tolerated.

Carbon fibers are being increasingly proposed for utilization as a reinforcing medium when embedded in a suitable matrix to form a strong lightweight structural component. Such composites find particular applicability in aerospace applications. There is accordingly a demand for high strength graphitic fibrous materials having uniform properties which may be reliably looked to for the desired reinforcement.

It is an object of the invention to provide an improved process for the conversion of certain acrylic fibrous materials to high strength graphitic fibrous materials.

It is an object of the invention to provide a process for the production of a graphitic fibrous material possessing essentially uniform mechanical properties, i.e. a high tensile strength and a high initial modulus.

It is another object of the invention to provide a process for the conversion of certain acrylic fibrous materials to graphitic fibrous materials in which the carbonization/graphitization portion of the process may be conducted on a reliable and stable basis wherein the desired tenacity is achieved without the necessity of resorting to the exertion of high longitudinal tensions upon the preoxidized fibrous material undergoing conversion.

It is another object of the invention to provide a process for the production of high tenacity graphitic fibrous materials which is relatively insensitive to variations in longitudinal tension during the carbonization/graphitization portion thereof.

It is a further object of the invention to provide a relatively rapid process for production of graphitic fibrous materials which does not require that the acrylic precursor be water washed to remove residual solvent prior to its utilization.

These and other objects, as well as the scope, nature, and utilization of the invention will be apparent from the following detailed description and appended claims.

SUMMARY OF THE INVENTION

It has been found that an improved process for the conversion of a drawn acrylic fibrous material selected from the group consisting of an acrylonitrile homopolymer and acrylonitrile copolymers which contain at least about 95 mol per cent of acrylonitrile units and up to about 5 mol per cent of one or more monovinyl units copolymerized therewith to a high strength graphitic fibrous material comprises:

a. continuously passing a continuous length of said acrylic fibrous material for a residence time of about 90 to 900 seconds through a pretreatment heating zone provided with a gaseous atmosphere at a temperature of about 170° to 220°C. while under a longitudinal tension sufficient to permit up to about a 20 per cent reduction in length brought about through shrinkage or the maintenance of a constant length, b. continuously withdrawing said continuous length of the resulting pretreated fibrous material from said heating zone.

c. continuously passing said resulting continuous length of pretreated fibrous material for a residence time of about 90 to 210 minutes through a preoxidation heating zone provided with an oxygen-containing atmosphere at a temperature of about 260° to 290°C., and d. continuously passing a continuous length of said resulting preoxidized fibrous material while under a longitudinal tension of about 0.05 to 0.8 grams per denier through a carbonization/graphitization heating zone provided with an inert atmosphere and a temperature gradient in which said fibrous material is raised within a period of about 20 to about 300 seconds from about 800°C. to a temperature of about 1600°C. to form a continuous length of carbonized fibrous material, and in which said carbonized fibrous material is subsequently raised from 1600°C. to a temperature within the range of about 2400 to about 3100°C. within a period of about 3 to 300 seconds where it is maintained for about 10 seconds to about 200 seconds to form a continuous length of graphitic fibrous material;

said steps (a) and (c) being conducted in accordance with the formula:

$$A = 3X_4(12X_2 + 8X_3 + 7X_4) + 17X_3 + 10X_4.$$

where $$X_2 = \frac{\text{Residence Time in Preoxidation Zone in Minutes-137}}{33}$$

$$X_3 = \frac{\text{Temperature of Preoxidation Zone in °C. - 277.5}}{7.5}$$

$$X_4 = \frac{\text{Per Cent Shrinkage in Pretreatment Zone - 12,}}{2.2}$$

and where A is equal to or less than 111.

The resulting graphitic fibrous materials commonly exhibit a single filament tensile strength of at least about 300,000 psi, and a single filament initial modulus of at least about 75,000,000 psi.

DESCRIPTION OF THE PREFERRED EMBODIMENTS

The Starting Material

Figure 1:
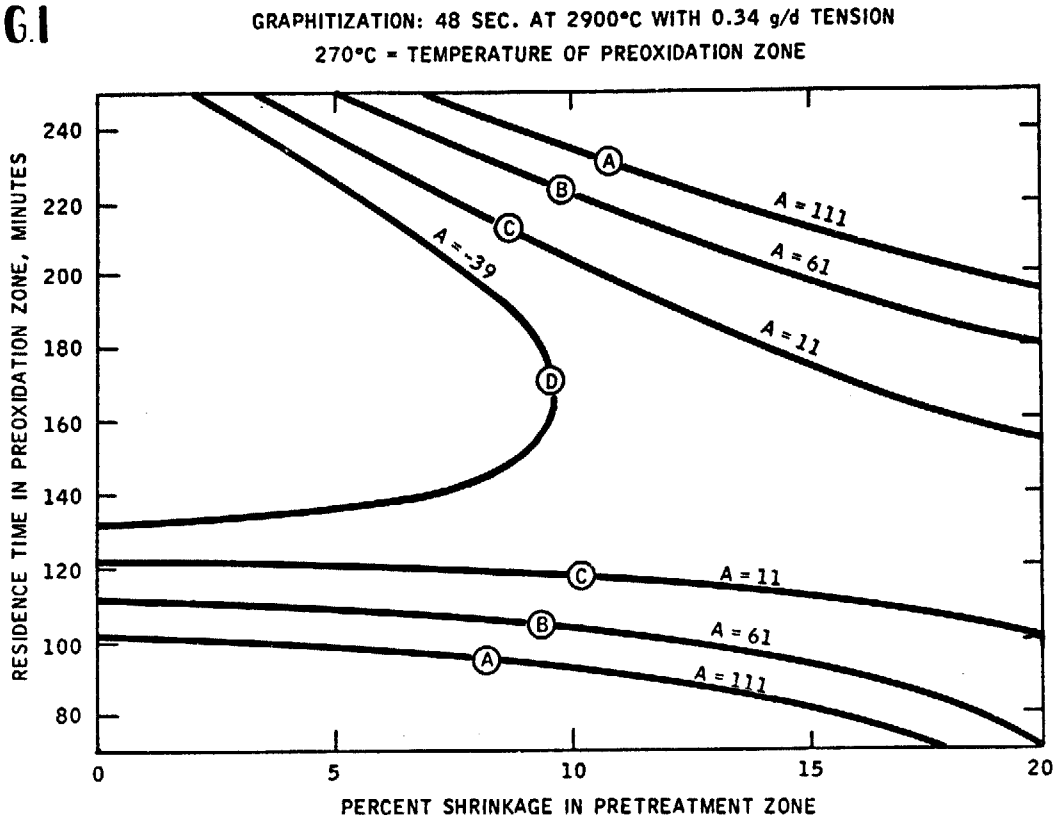
FIG. 1 is a representative response surface map which visually presents those operating areas in terms of A values wherein optimum graphite tensile strengths are achieved when operating at various pretreatment shrinkages and various preoxidation times holding the pretreatment temperature constant at 185°C., the preoxidation temperature constant at 270°C., the graphitization time constant at 48 seconds, and the longitudinal tension exerted upon the fibrous material within the carbonization/graphitization zone constant at 0.34 grams per denier.

The acrylic fibrous materials which serve as the starting materials in the present process are formed by conventional solution spinning techniques (i.e. are dry spun or wet spun), and are drawn to increase their orientation. As is known in the art, dry spinning is commonly conducted by dissolving the polymer in an appropriate solvent, such as N,N-dimethyl formamide or N,N-dimethyl acetamide, and passing the solution through an opening of predetermined shape into an evaporative atmosphere (e.g. nitrogen) in which much of the solvent is evaporated. Wet spinning is commonly conducted by passing a solution of the polymer through an opening of predetermined shape into an aqueous coagulation bath.

The acrylic polymer utilized as the starting material is either an acrylonitrile homopolymer or an acrylonitrile copolymer containing at least about 95 mol per cent of acrylonitrile units and up to about 5 mol per cent of one or more units derived from a monovinyl compound which is copolymerizable with acrylonitrile such as styrene, methyl acrylate, methyl methacrylate, vinyl acetate, vinyl chloride, vinylidene chloride, vinyl pyridine, and the like.

The acrylic fibrous materials are provided as continuous lengths and may be in a variety of physical configurations. For instance, the acrylic fibrous materials may be present in the form of continuous lengths of multifilament yarns, tows, strands, cables, tapes, or similar fibrous assemblages.

When the starting material is a continuous multifilament yarn, a twist may be imparted to the same to improve the handling characteristics. For instance, a twist of about 0.1 to 5 tpi, and preferably about 0.3 to 1.0 tpi may be utilized. Also a false twist may be used instead of or in addition to a real twist. Alternatively, one may select bundles of fibrous material which possess essentially no twist.

The starting material is drawn in accordance with conventional techniques in order to improve its orientation. For instance, the starting material may be drawn by stretching while in contact with a hot shoe at a temperature of about 140° to 160°C. Additional representative drawing techniques are disclosed in U.S. Pat. Nos. 2,455,173; 2,948,581; and 3,122,412. It is recommended that the acrylic fibrous materials selected for use in the process be drawn to a single filament tenacity of at least about 3 grams per denier. If desired, however, the starting material may be more highly oriented, e.g. drawn up to a single filament tenacity of about 7.5 to 8 grams per denier, or more.

The acrylic fibrous material which is converted to a graphitic fibrous material in accordance with the present process may or may not contain an appreciable quantity of residual solvent. In a preferred embodiment of the invention the fibrous material is unwashed and contains about 2 to 10 per cent by weight residual solvent. In a particularly preferred embodiment of the invention the fibrous material is dry spun, unwashed, and contains about 2 to 10 per cent by weight of residual N,N-dimethyl formamide or N,N-dimethyl acetamide. Residual N,N-dimethyl formamide or N,N-dimethyl acetamide contents of about 2 to 5 per cent by weight are commonly encountered in such unwashed dry spun fiber. Alternatively, the starting material may have been previously washed and contain essentially no solvent prior to introduction into the heating zone described hereafter. The acrylic fibrous materials treated in the present process commonly have an inherent tendency to shrink in length when heated at about 170° to 220°C. (e.g. at about 185° to 220°C.).

The acrylic fibrous material which serves as the starting material in the present invention has not been previously thermally stabilized, such as by exposure to an oxygen-containing atmosphere at an elevated temperature for an extended period of time. The properties of the acrylic fibrous material as it is withdrawn from the pretreatment heating zone, described hereafter, are dissimilar to those of a thermally stabilized acrylic fibrous material. For instance, during thermal stabilization the bound oxygen content of the acrylic fibrous material increases to at least about 7 per cent by weight and possibly as high as 18 per cent by weight as determined by the Unterzaucher analysis. Not only is the fibrous material upon thermal stabilization rendered black in appearance, and non-burning to a match flame, but its mechanical properties such as tenacity are substantially reduced. The pretreatment heating step described hereafter generally results in no substantial diminution of mechanical properties, such as tenacity. Also, even if the pretreatment heating step, described hereafter, were conducted in an oxygen-containing atmosphere, such as air, no appreciable increase in the bound oxygen content as determined by the Unterzaucher analysis results (i.e. less than a one per cent increase in bound oxygen) during the passage of the fibrous material through the pretreatment heating zone.

The Pretreatment Heating Step

In accordance with the present invention the continuous length of acrylic fibrous material is continuously introduced into a pretreatment heating zone provided with a gaseous atmosphere at the temperature indicated. The nature of the gaseous atmosphere is not critical and may be varied widely. For instance, ordinary air may be utilized, or alternatively the atmosphere may be inert, e.g. nitrogen, argon, etc. The gaseous atmosphere which is selected should not be one which is unduely reactive with the acrylic fibrous material so as to diminsh its mechanical properties under the conditions of the heat treatment.

The gaseous atmosphere of the pretreatment heating zone is provided at a temperature of about 170° to 220°C. In a preferred embodiment of the invention the gaseous atmosphere is at a temperature of about 185° to 220°C. In a particularly preferred embodiment of the invention the gaseous atmosphere is at a temperature of about 190° to 220°C. If the acrylic fibrous material undergoing treatment contains an appreciable quantity of residual solvent, it is recommended that provision be made for circulating the atmosphere or for the withdrawal of solvent generated during the pretreatment heating step.

The equipment utilized to produce the requisite temperatures to carry out the pretreatment heating step may be varied widely as will be apparent to those skilled in the art. For instance, the continuous length of acrylic fibrous material may be passed through a circulating oven, or the tube of a muffle furnace. The speed of movement through the pretreatment heating zone will be determined by the size of the zone and the desired residence as discussed hereafter. Rollers or guides may be provided within the zone to direct the movement of the continuous length of acrylic fibrous material. In a preferred embodiment of the invention the acrylic fibrous material is passed through the pretreatment heating zone in the direction of its length and is substantially suspended therein with minimal contact with guides or rollers. If desired, the continuous length of fibrous material may be passed through the pretreatment heating zone a plurality of passes until the desired residence time is achieved.

The acrylic fibrous material is passed through the pretreatment heating zone for a residence time of about 90 to 900 seconds. If the residence time is much below about 90 seconds then the desired enhancement of fiber properties accomplished in the pretreatment heating zone tends to be insufficiently achieved. If the residence time is much more than about 900 seconds, then the thermal stabilization reaction tends to take over. In a preferred embodiment of the invention the acrylic fibrous material is passed through the pretreatment heating zone for a residence time of about 90 to 500 seconds. Also, it is preferred that the residual solvent content of acrylic fibrous material treated in accordance with the present invention be less than about 0.1 per cent by weight at the time of its withdrawal from the pretreatment heating zone. Such solvent content determinations can be made by conventional gas chromatography techniques.

While passing through the pretreatment heating zone, the longitudinal tension on the continuous length of acrylic fibrous material is adjusted so that it is sufficient to permit up to a 20 per cent reduction in length brought about through shrinkage, or the maintenance of a constant length. In a preferred embodiment of the invention the longitudinal tension on the continuous length of fibrous material is sufficient to permit a reduction in length of about 5 to 15 per cent brought about through shrinkage. The relative tension exerted upon the continuous length of fibrous material may be adjusted through a proper selection of feed and withdrawal rates taking into consideration the inherent tendency of the fibrous material to shrink.

The theory whereby the pretreatment step of the present process enhances the properties of the continuous length of fibrous material is considered complex and incapable of simple explanation. It has been found, however, that a more uniform and more dense microstructure results which is believed to be produced through the healing of voids and the release of internal stress. The more uniform morphology of the pretreated fiber is also believed to be carried over the graphitic fiber ultimately derived therefrom.

The pretreatment heating step of the present process is fully described in our commonly assigned U.S. Ser. No. 17,962 (now abandoned), filed concurrently herewith, which is herein incorporated by reference.

The Preoxidation Heating Step

The continuous length of pretreated fibrous material is next continuously stabilized (i.e. preoxidized) at a relatively severe temperature. The preoxidation heating step may be conducted in accordance with certain embodiments of commonly assigned U.S. Ser. No. 749,957, filed Aug. 5, 1968, (now abandoned) of Dagobert E. Stuetz, which is herein incorporated by reference.

More specifically, the continuous length of pretreated fibrous material is continuously introduced, passed through, and continuously withdrawn from a preoxidation heating zone provided at a temperature of about 260° to 290°C. The pretreated fibrous material is maintained in the preoxidation heating zone for a residence time of about 90 to 210 minutes. The preoxidation heating step is preferably conducted in tandem with the pretreatment heating step with the pretreated fibrous material as it is withdrawn from the pretreatment heating zone being passed directly to the preoxidation heating zone.

It is essential that the heated atmosphere which is provided within the preoxidation heating zone be oxygen-containing so that the desired stabilization reaction brought about by preoxidation is accomplished. The preferred oxygen-containing atmosphere is air.

In a preferred embodiment of the invention a longitudinal tension is exerted upon the continuous length of pretreated fibrous material whereby a constant length is maintained while passing through the preoxidation heating zone.

The fibrous material as it is withdrawn from the preoxidation heating zone (1) retains essentially the same fibrous configuration as the starting material, (2) is capable of undergoing carbonization, (3) is black in appearance, and (4) is non-burning when subjected to an ordinary match flame. Even if the acrylic fibrous material which was originally introduced into the pretreatment heating zone was unwashed and originally contained an appreciable residual solvent content, the fibrous material following treatment in the preoxidation heating zone is essentially non-coalesced. The stabilized fibrous material as it is withdrawn from the preoxidation heating zone commonly exhibits a bound oxygen content of at least about 7 per cent by weight as determined by the Unterzaucher analysis.

The equipment utilized to produce the requisite temperatures to carry out the preoxidation heating step may be varied widely as will be apparent to those skilled in the art. For instance, the continuous length of pretreated fibrous material may be passed through a circulating oven, or the tube of a muffle furnace provided with the requisite oxygen-containing atmosphere, such as air. The speed of movement of the pretreated fibrous material through the preoxidation heating zone will be determined by the size of the heating zone and the desired residence time. Rollers or guides may be provided within the preoxidation heating zone to direct the movement of the continuous length of pretreated fibrous material. In a preferred embodiment of the invention the acrylic fibrous material is passed through the preoxidation heating zone in the direction of its length and is substantially suspended therein with minimal contact with guides or rollers. If desired, the continuous length of fibrous material may be passed through the preoxidation heating zone for a plurality of passes until the desired residence time is achieved.

The Carbonization/Graphitization Heating Step

The continuous length of pretreated and preoxidized fibrous material is next continuously passed through a carbonization/graphitization heating zone provided with a temperature gradient (described hereafter) wherein a high strength graphitic fibrous material is ultimately produced. The carbonization/graphitization step may be connected in accordance with certain embodiments of commonly assigned U.S. Ser. No. 777,275, filed Nov. 20, 1968 (now abandoned) of Charles M. Clarke, which is herein incorporated by reference.

An inert non-oxidizing atmosphere is provided within the carbonization/graphitization heating zone. Representative inert atmospheres for utilization in the zone include nitrogen, argon, and helium. The preferred inert atmospheres are nitrogen and argon.

Since the pretreated and preoxidized fibrous material is generally inherently hygroscopic, it is recommended that it be supplied to the carbonization/graphitization heating zone in an essentially anhydrous form in accordance with the teachings of commonly assigned U.S. Ser. No. 17,780, filed Mar. 9, 1970 (now U.S. Pat. No. 3,677,705), of Charles M. Clarke, Michael J. Ram, and John P. Riggs which is herein incorporated by reference.

The continuous length of pretreated and preoxidized fibrous material is generally provided at a temperature of about 20° to 500°C. at the time it is introduced into the carbonization/graphitization heating zone and is elevated to 800°C. The temperature gradient within the carbonization/graphitization heating zone raises the fibrous material from about 800° to about 1600°C. within about 20 to about 300 seconds to form a continuous length of carbonized fibrous material, and subsequently raises the carbonized fibrous material from about 1600°C. to a temperature within the range of about 2400° to about 3100°C. within a period of about 3 to 300 seconds where it is maintained for about 10 seconds to about 200 seconds to form a continuous length of graphitic fibrous material. In a preferred embodiment of the invention the fibrous material is raised from about 800° to about 1600°C. within about 45 to 300 seconds. A preferred maximum graphitization temperature is about 2900° ± 50°C. where the fiber is maintained for about 20 to 60 seconds. Graphitic carbon in the fibrous product may be determined by the characteristic x-ray diffraction pattern of graphite.

While the continuous length of resulting preoxidized fibrous material is passed through the carbonization/graphitization heating zone, it is placed under a longitudinal tension of about 0.05 to 0.8 grams per denier. In a preferred embodiment of the invention the preoxidized fibrous material is under a longitudinal tension of about 0.3 to 0.5 grams per denier while passing through the carbonization/graphitization heating zone. The longitudinal tension exerted upon the fibrous material may be satisfactorily adjusted by controlling the relative rates of introduction and withdrawal of the fibrous material while passing through the carbonization/graphitization heating zone.

It has been found that when the acrylic fibrous material has been pretreated at a temperature of about 185° to 220°C., and when the temperature gradient within the carbonization/graphitization zone raises the fibrous material from about 800° to a temperature of about 1600°C. within a period of about 45 to about 300 seconds, then the carbonization/graphitization portion of the present process tends to be relatively insensitive to longitudinal tension. Under such conditions a high tenacity product is produced over a wide range of tensions. The exact pretreatment temperature range which is required in order to yield this unexpected tension response has been found to vary somewhat with different precursors, however, the pretreatment temperature range of about 190° to 220°C. tends to be preferred for the most pronounced observance of this response.

The equipment utilized to produce the requisite heating to carry out the carbonization/graphitization heating step of the present process may be varied widely as will be apparent to those skilled in the art. It is essential that the apparatus selected be capable of producing the required temperature while excluding the presence of an oxidizing atmosphere. For instance, suitable apparatus include induction furnaces, tube furnaces in which a hollow graphite susceptor is heated by direct resistance heating, and the like.

In a preferred embodiment of the invention, the continuous length of preoxidized fibrous material is heated by use of an induction furnace. In such a procedure, the continuous length of stabilized material is passed through a hollow graphite tube or susceptor which is situated within the windings of an induction coil. By varying the length of the graphite susceptor, the length of the induction coil, and the rate at which the fibrous material is passed through the susceptor, many apparatus arrangements capable of carrying out the present process may be selected. For large scale production, it is of course preferred that relatively long susceptors and extended heating zones be used so that the continuous length of fibrous material may be passed through the same at a higher rate while still being heated in accordance with the desired temperature gradient.

Study of Process Parameters

Table I presents representative graphite tensile strength values achieved under a variety of conditions in which the pretreatment temperature and shrinkages were varied, as well as the carbonization/graphitization tension and times.

A continuous length of a 1600 fil dry spun acrylonitrile homopolymer continuous filament yarn having a total denier of 1920 was selected as the starting material. The yarn was dry spun from a solution of the same in an N,N-dimethyl formamide solvent into an evaporative atmosphere of nitrogen. The fibrous material was dry spun as a 40 fil bundle, and plied to form the 1600 fil yarn which exhibited a twist of about 0.5 tpi.

The yarn was next drawn at a draw ratio of about 5:1 to a single filament tenacity of about 4 grams per denier by stretching while passing over a hot shoe at a temperature of about 160°C. for a residence time of about 0.5 second. Contrary to standard acrylic fiber technology the acrylic yarn was not washed and contained a residual N,N-dimethyl formamide solvent content of about 4 per cent by weight. The yarn also exhibited an inherent tendency to shrink in length when heated to about 170° to 220°C.

The unwashed acrylonitrile homopolymer yarn was next continuously introduced in the direction of its length into a 50 inch muffle furnace (pretreatment heating zone) having an internal diameter of 1.25 inches. A gaseous atmosphere of air at the temperatures indicated (170° to 215°C.) was provided within the muffle furnace. The yarn was passed through the muffle furnace for 3 passes at a speed of 30 inches per minute for a total residence time of 300 seconds. Roller guides were provided at each end of the muffle furnace to facilitate the multiple passes. While passing through the muffle furnace, the longitudinal tension exerted upon the continuous length of fibrous material was adjusted so that shrinkages of 10 or 15 per cent were recorded at the end of the final pass. The resulting yarn exhibited a residual N,N-dimethyl formamide content of less than 0.1 per cent by weight. Also, the bound oxygen content remained substantially unchanged following the heat treatment.

The resulting pretreated yarn was next passed directly to an adjoining preoxidation heating zone. The preoxidation treatment was conducted while the pretreated yarn was continuously passed in the direction of its length through a multi-wrap skewed roll oven provided with circulating air at 270°C. The residence time within the preoxidation heating zone was constant at 120 minutes in each treatment. While passing through the preoxidation heating zone, a longitudinal tension was exerted upon the treated fibrous material whereby an essentially constant length was maintained. The resulting preoxidized yarn was black in appearance, non-burning when subjected to an ordinary match flame, and had a bound oxygen content of about 10 per cent by weight as determined by the Unterzaucher analysis. Upon withdrawal from the preoxidation zone the continuous lengths of preoxidized fibrous material were wound upon bobbins and stored in a forced air oven at 110°C.

The preoxidized fibrous material was dried in an in line continuous manner immediately prior to its introduction into an induction furnace provided with a nitrogen atmosphere and a temperature gradient wherein both carbonization and substantial graphitization occurred. Drying was conducted by passing the preoxidized yarn in the direction of its length through four 12 inch muffle furnaces placed in an end to end relationship and provided with circulating air at 200°C., 250°C., 300°C., and 340°C., respectively.

The preoxidized yarns were passed through the drying zone and the carbonization/graphitization zone at rates of 10 inches per minute and 30 inches per minute. Various longitudinal tensions of 0.08 to 0.72 grams per denier were exerted upon the fibrous material as it passed through the carbonization/graphitization zone. The induction furnace comprised an Inductotherm model Inducto 50 unit provided with a 50 KW power source, a 12 turn water cooled copper coil having a length of 19 inches, and a hollow graphite tube suspended within the coil having a total length of 55 inches. The copper coil had an inner diameter of 8 inches, and the copper tubing from which it was formed was of 0.75 inch outer diameter with a wall thickness of 0.125 inch. The 55 inch hollow graphite tube was provided in two adjoining sections. The main section was 45 inches in length, and had an outer diameter of 3 inches and an inner diameter of 0.75 inch. The auxiliary section was 10 inches in length and was located at the exit end of the main susceptor and had an outer diameter of 2 inches and an inner diameter of 0.75 inch. The copper coil encompassed the main susceptor and had its end located two inches from the point where the main susceptor and the auxiliary susceptor were joined. Thermal insulation in a depth of 5 inches totally surrounded the graphite tube. Air was substantially excluded from the induction furnace by purging with nitrogen. The yarn was raised to a maximum temperature of about 2900°C. while passing through the carbonization/graphitization zone.

When passing through the carbonization/graphitization heating zone at a rate of 10 inches per minute the yarn was raised to a temperature of 800°C. in approximately 48 seconds after entering the graphite tube, from 800° to 1600°C. in approximately 72 seconds, and from 1600° to 2900°C. in approximately 60 seconds where it was maintained ±50°C. for about 48 seconds. When passing through the carbonization/graphitization heating zone at a rate of 30 inches per minute, the yarn was raised to a temperature of 800°C. in approximately 16 seconds after entering the graphite tube, from 800° to 1600°C. in approximately 24 seconds, from 1600° to 2900°C. in approximately 20 seconds where it was maintained ±50°C. of 2900°C. for about 16 seconds. The resulting graphitic yarns exhibited a specific gravity of about 2.0.

TABLE I

| Pretreatment Temperature in °C. | Pretreatment Time in Seconds | Pretreatment Longitudinal Shrinkage* (Per Cent) | Preoxidation Temperature in °C. | Preoxidation Time in Minutes | Carbonization/ Graphitization Tension in Grams per Denier | Time at Graphitization Temperature in Seconds | Single Filament Tensile Strength in psi**(× 1000) |
|---|---|---|---|---|---|---|---|
| 170 | 300 | 10 | 270 | 120 | 0.17 | 48 | 403 |
| 170 | 300 | 10 | 270 | 120 | 0.36 | 48 | 438 |
| 185 | 300 | 10 | 270 | 120 | 0.09 | 48 | 413 |
| 185 | 300 | 10 | 270 | 120 | 0.29 | 48 | 352 |
| 185 | 300 | 10 | 270 | 120 | 0.54 | 48 | 445 |
| 185 | 300 | 15 | 270 | 120 | 0.08 | 48 | 388 |
| 185 | 300 | 15 | 270 | 120 | 0.27 | 48 | 413 |
| 200 | 300 | 10 | 270 | 120 | 0.08 | 48 | 352 |
| 200 | 300 | 10 | 270 | 120 | 0.18 | 48 | 397 |

TABLE I-continued

| Pretreatment Temperature in °C. | Pretreatment Time in Seconds | Pretreatment Longitudinal Shrinkage* (Per Cent) | Preoxidation Temperature in °C. | Preoxidation Time in Minutes | Carbonization/ Graphitization Tension in Grams per Denier | Time at Graphitization Temperature in Seconds | Single Filament Tensile Strength in psi**(× 1000) |
|---|---|---|---|---|---|---|---|
| 200 | 300 | 10 | 270 | 120 | 0.27 | 48 | 445 |
| 200 | 300 | 10 | 270 | 120 | 0.36 | 48 | 417 |
| 200 | 300 | 10 | 270 | 120 | 0.45 | 48 | 432 |
| 200 | 300 | 10 | 270 | 120 | 0.58 | 48 | 414 |
| 200 | 300 | 10 | 270 | 120 | 0.69 | 48 | 388 |
| 200 | 300 | 10 | 270 | 120 | 0.80 | 48 | 417 |
| 200 | 300 | 15 | 270 | 120 | 0.16 | 48 | 378 |
| 200 | 300 | 15 | 270 | 120 | 0.35 | 48 | 452 |
| 200 | 300 | 15 | 270 | 120 | 0.55 | 48 | 417 |
| 215 | 300 | 10 | 270 | 120 | 0.10 | 48 | 350 |
| 215 | 300 | 10 | 270 | 120 | 0.20 | 48 | 362 |
| 215 | 300 | 10 | 270 | 120 | 0.32 | 48 | 320 |
| 215 | 300 | 10 | 270 | 120 | 0.43 | 48 | 285 |
| 215 | 300 | 10 | 270 | 120 | 0.55 | 48 | 272 |
| 215 | 300 | 15 | 270 | 120 | 0.08 | 48 | 358 |
| 215 | 300 | 15 | 270 | 120 | 0.28 | 48 | 282 |
| 215 | 300 | 15 | 270 | 120 | 0.48 | 48 | 210 |
| 170 | 300 | 10 | 270 | 120 | 0.18 | 16 | 355 |
| 170 | 300 | 10 | 270 | 120 | 0.38 | 16 | 405 |
| 185 | 300 | 10 | 270 | 120 | 0.19 | 16 | 368 |
| 185 | 300 | 10 | 270 | 120 | 0.40 | 16 | 352 |
| 185 | 300 | 15 | 270 | 120 | 0.08 | 16 | 352 |
| 200 | 300 | 10 | 270 | 120 | 0.09 | 16 | 320 |
| 200 | 300 | 10 | 270 | 120 | 0.17 | 16 | 325 |
| 200 | 300 | 10 | 270 | 120 | 0.27 | 16 | 338 |
| 200 | 300 | 10 | 270 | 120 | 0.37 | 16 | 410 |
| 200 | 300 | 10 | 270 | 120 | 0.46 | 16 | 400 |
| 200 | 300 | 10 | 270 | 120 | 0.59 | 16 | 380 |
| 200 | 300 | 10 | 270 | 120 | 0.72 | 16 | 262 |
| 200 | 300 | 15 | 270 | 120 | 0.17 | 16 | 378 |
| 200 | 300 | 15 | 270 | 120 | 0.37 | 16 | 440 |
| 215 | 300 | 10 | 270 | 120 | 0.09 | 16 | 243 |
| 215 | 300 | 10 | 270 | 120 | 0.20 | 16 | 252 |
| 215 | 300 | 10 | 270 | 120 | 0.30 | 16 | 260 |
| 215 | 300 | 10 | 270 | 120 | 0.40 | 16 | 332 |
| 215 | 300 | 15 | 270 | 120 | 0.17 | 16 | 247 |
| 215 | 300 | 15 | 270 | 120 | 0.37 | 16 | 260 |

*Plus or minus one per cent
**Average of five breaks

Table II presents representative graphite tensile strength values achieved under a variety of conditions in which the pretreatment shrinkage and times were varied, the preoxidation temperature and times were varied, and carbonization/graphitization tension and times were varied.

The acrylonitrile homopolymer yarn was substantially identical to that described in connection with the process runs reported in Table I. Also, the same equipment was utilized under the conditions reported in connection with the runs of Table I, except as indicated. More specifically, the longitudinal shrinkage in the pretreatment zone varied from 9.2 to 15.6 per cent, and the pretreatment residence times varied from about 250 to 500 seconds. The preoxidation temperatures were 270° and 285°C., and preoxidation times varied from 88 to 197 minutes. The preoxidized yarn was passed through the induction furnace at rates of 10 and 30 inches per minute, and was exposed to the same temperature gradients as discussed in connection with the runs of Table I. Various longitudinal tensions of 0.08 to 0.76 grams per denier were exerted upon the fibrous material as it passed through the carbonization/graphitization zone. The resulting graphitic yarns exhibited a specific gravity of about 2.0.

TABLE II

| Pretreatment Temperature in °C. | Pretreatment Time in Seconds | Pretreatment Longitudinal Shrinkage (Per Cent) | Preoxidation Temperature | Preoxidation Time in Minutes | Carbonization/ Graphitization Tension in Grams per Denier | Time at Graphitization Temperature in Seconds | Single Filament Tensile Strength in psi**(× 1000) |
|---|---|---|---|---|---|---|---|
| 185 | 300 | 9.3 | 270 | 116 | 0.09 | 48 | 413 |
| 185 | 300 | 9.3 | 270 | 116 | 0.29 | 48 | 352 |
| 185 | 300 | 9.3 | 270 | 116 | 0.54 | 48 | 445 |
| 185 | 300 | 15.6 | 270 | 119 | 0.08 | 48 | 388 |
| 185 | 300 | 15.6 | 270 | 119 | 0.27 | 48 | 413 |
| 185 | 400 | 10.6 | 270 | 158 | 0.09 | 48 | 422 |
| 185 | 400 | 10.6 | 270 | 158 | 0.28 | 48 | 432 |
| 185 | 400 | 10.6 | 270 | 158 | 0.51 | 48 | 417 |
| 185 | 400 | 13.6 | 270 | 158 | 0.09 | 48 | 414 |
| 185 | 400 | 13.6 | 270 | 158 | 0.18 | 48 | 412 |
| 185 | 400 | 13.6 | 270 | 158 | 0.29 | 48 | 380 |
| 185 | 400 | 13.6 | 270 | 158 | 0.55 | 48 | 390 |
| 185 | 400 | 13.6 | 270 | 158 | 0.76 | 48 | 405 |
| 185 | 500 | 9.2 | 270 | 197 | 0.14 | 48 | 355 |
| 185 | 500 | 9.2 | 270 | 197 | 0.30 | 48 | 435 |
| 185 | 500 | 9.2 | 270 | 197 | 0.48 | 48 | 388 |
| 185 | 250 | 10.7 | 285 | 88 | 0.09 | 48 | 364 |
| 185 | 250 | 10.7 | 285 | 88 | 0.28 | 48 | 282 |
| 185 | 250 | 10.7 | 285 | 88 | 0.52 | 48 | 285 |
| 185 | 250 | 13.9 | 285 | 88 | 0.09 | 48 | 362 |

TABLE II-continued

| Pretreatment Temperature in °C. | Pretreatment Time in Seconds | Pretreatment Longitudinal Shrinkage (Per Cent) | Preoxidation Temperature | Preoxidation Time in Minutes | Carbonization/ Graphitization Tension in Grams per Denier | Time at Graphitization Temperature in Seconds | Single Filament Tensile Strength in psi**(× 1000) |
|---|---|---|---|---|---|---|---|
| 185 | 250 | 13.9 | 285 | 88 | 0.28 | 48 | 365 |
| 185 | 250 | 13.9 | 285 | 88 | 0.50 | 48 | 355 |
| 185 | 250 | 13.9 | 285 | 88 | 0.75 | 48 | 395 |
| 185 | 300 | 15.6 | 285 | 118 | 0.21 | 48 | 360 |
| 185 | 300 | 15.6 | 285 | 118 | 0.42 | 48 | 420 |
| 185 | 300 | 15.6 | 285 | 118 | 0.67 | 48 | 427 |
| 185 | 400 | 10.6 | 285 | 160 | 0.16 | 48 | 335 |
| 185 | 400 | 10.6 | 285 | 160 | 0.35 | 48 | 452 |
| 185 | 400 | 10.6 | 285 | 160 | 0.53 | 48 | 410 |
| 185 | 400 | 10.6 | 285 | 160 | 0.15 | 48 | 355 |
| 185 | 400 | 10.6 | 285 | 160 | 0.32 | 48 | 405 |
| 185 | 400 | 10.6 | 285 | 160 | 0.51 | 48 | 410 |
| 185 | 400 | 13.6 | 285 | 158 | 0.23 | 48 | 262 |
| 185 | 400 | 13.6 | 285 | 158 | 0.47 | 48 | 332 |
| 185 | 300 | 9.3 | 270 | 116 | 0.19 | 16 | 368 |
| 185 | 300 | 9.3 | 270 | 116 | 0.40 | 16 | 352 |
| 185 | 300 | 15.6 | 270 | 116 | 0.08 | 16 | 352 |
| 185 | 400 | 10.6 | 270 | 158 | 0.18 | 16 | 385 |
| 185 | 400 | 10.6 | 270 | 158 | 0.40 | 16 | 412 |
| 185 | 400 | 13.6 | 270 | 158 | 0.09 | 16 | 325 |
| 185 | 400 | 13.6 | 270 | 158 | 0.19 | 16 | 420 |
| 185 | 400 | 13.6 | 270 | 158 | 0.29 | 16 | 482 |
| 185 | 400 | 13.6 | 270 | 158 | 0.42 | 16 | 360 |
| 185 | 400 | 13.6 | 270 | 158 | 0.55 | 16 | 383 |
| 185 | 400 | 13.6 | 270 | 158 | 0.29 | 16 | 390 |
| 185 | 500 | 9.2 | 270 | 197 | 0.14 | 16 | 305 |
| 185 | 500 | 9.2 | 270 | 197 | 0.31 | 16 | 378 |
| 185 | 500 | 9.2 | 270 | 197 | 0.47 | 16 | 417 |
| 185 | 250 | 10.7 | 285 | 88 | 0.19 | 16 | 293 |
| 185 | 250 | 10.7 | 285 | 88 | 0.42 | 16 | 313 |
| 185 | 250 | 10.7 | 285 | 88 | 0.64 | 16 | 345 |
| 185 | 250 | 13.9 | 285 | 88 | 0.18 | 16 | 342 |
| 185 | 250 | 13.9 | 285 | 88 | 0.38 | 16 | 410 |
| 185 | 250 | 13.9 | 285 | 88 | 0.64 | 16 | 295 |
| 185 | 300 | 9.9 | 285 | 120 | 0.10 | 16 | 282 |
| 185 | 300 | 9.9 | 285 | 120 | 0.20 | 16 | 390 |
| 185 | 300 | 9.9 | 285 | 120 | 0.30 | 16 | 372 |
| 185 | 300 | 9.9 | 285 | 120 | 0.45 | 16 | 384 |
| 185 | 300 | 9.9 | 285 | 120 | 0.64 | 16 | 325 |
| 185 | 300 | 15.6 | 285 | 118 | 0.21 | 16 | 308 |
| 185 | 300 | 15.6 | 285 | 118 | 0.42 | 16 | 390 |
| 185 | 300 | 15.6 | 285 | 118 | 0.73 | 16 | 398 |
| 185 | 400 | 10.6 | 285 | 160 | 0.16 | 16 | 292 |
| 185 | 400 | 10.6 | 285 | 160 | 0.33 | 16 | 330 |
| 185 | 400 | 13.6 | 285 | 158 | 0.23 | 16 | 238 |
| 185 | 400 | 13.6 | 285 | 158 | 0.45 | 16 | 367 |
| 185 | 400 | 13.6 | 285 | 158 | 0.76 | 16 | 367 |

**Average of five breaks

Having made extensive empirical experimentation and the compilation of substantial experimental data, a mathematical equation was obtained which specifies the general relationship of the variables of the present process for optimum results, and which aids one in selecting a combination of variables wherein a fibrous graphitic material of various high levels of tensile strength may be produced. It was determined that a second order polynomial function would be satisfactory to relate graphite properties to the experimental variables. The form of the second-order polynomial and its use to summarize process data are discussed, for example, in "The Design and Analysis of Industrial Experiments" edited by O. L. Davies, Hafner Publishing Company, New York, 1956, Chapter 11.

The second order polynomial was derived by an analysis of the experimental data by way of least squares calculations. A procedure which uses a digital computer to perform the least squares calculations to derive the parameters of the second-order polynomial, and to present the results in the form of response surface maps is reported by P. A. C. Cook and A. J. Rosenthal in the "Annual Technical Conference Transactions 1969" published by American Society for Quality Control, pages 161–172, May, 1969. Selecting preferred carbonization/graphitization conditions of 48 seconds while at 2900°C. ± 50°C., a longitudinal carbonization/graphitization tension of 0.34 grams per denier, and the carbonization/graphitization temperature gradient heretofore discussed, it was found that the estimated single filament tensile strength of the graphitic fibrous material expressed in thousands of psi could be calculated from the following equation:

$$\text{Estimated Tensile Strength} = 411 - 17X_3 - 10X_4 - 37X_2^2 - 24X_2X_3 - 21X_2X_4 \quad (1)$$

where $$X_2 = \frac{\text{Residence Time in Preoxidation Zone in Minutes} - 137}{33}$$

$$X_3 = \frac{\text{Temperature of Preoxidation Zone in °C.} - 277.5}{7.5}$$

$$X_4 = \frac{\text{Per Cent Shrinkage in Pretreatment Zone} - 12.}{2.2}$$

To achieve single filament graphite tensile strengths in excess of 300,000 psi utilizing the process of the present invention it is generally necessary to select conditions wherein the per cent shrinkage in the pretreatment zone, the temperature of the preoxidation zone, and the residence time in the preoxidation zone are such that the right-hand side of the equation (1) is equal to or greater than 300. Inserting 300 for the estimated tensile strength and regrouping the terms, one determines that the desired fiber properties are generally expected if a parameter:

$$A = 3X_2(12X_2 + 8X_3 + 7X_4) + 17X_3 + 10X_4$$

is equal to or less than 111.

It accordingly follows that the estimated single filament tensile strength will generally be in excess of 350,000 psi if A is equal to or less than 61. The estimated single filament tensile strength will generally be in excess of 400,000 psi if A is equal to or less than 11. The estimated single filament tensile strength will generally be in excess of 450,000 psi if A is equal to or less than minus 39. A single filament initial modulus in excess of 75,000,000 psi can generally also be expected when A is equal to or less than 111. The above A values should not be considered as an absolute prediction of tensile strength values. The utilization of the above formula is highly useful, however, in selecting variables to be employed in the process of the present invention.

FIG. 1 is a representative response surface map which visually presents those operating areas in terms of A values wherein optimum graphite tensile strengths are achieved when operating at various pretreatment shrinkages and various preoxidation times holding the pretreatment temperature constant at 185°C., the preoxidation temperature constant at 270°C., the graphitization time constant at 48 seconds while at 2900° ±50°C., and the longitudinal tension exerted upon the fibrous material within the carbonization/graphitization zone constant at 0.34 grams per denier. Line A corresponds to an A value of 111. Line B corresponds to an A value of 61. Line C corresponds to an A value of 11. Line D corresponds to an A value of minus 39.

Figure 2:
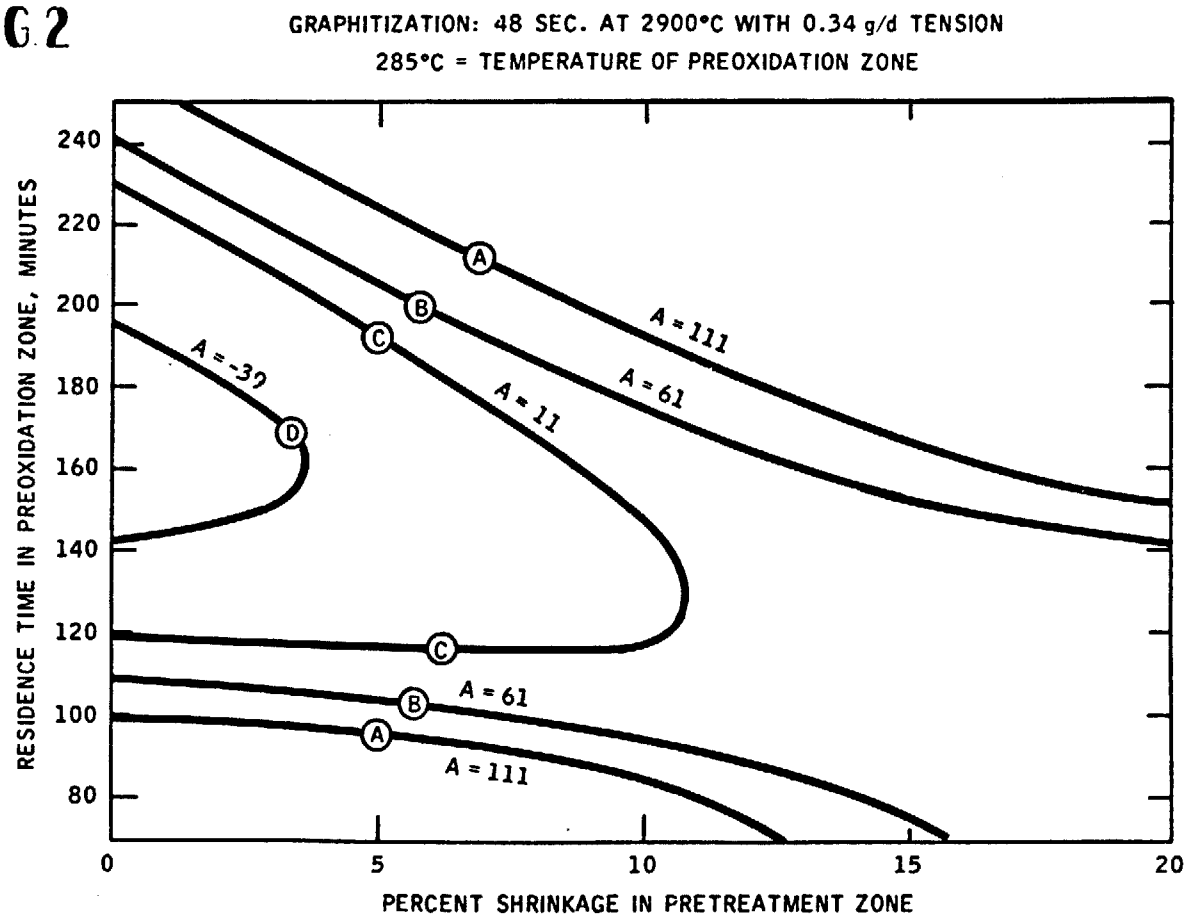
FIG. 2 is a response surface map similar to that of FIG. 1 with the exception that the preoxidation temperature is held constant at 285°C., rather than 270°C.

FIG. 2 is a response surface map similar to that of FIG. 1 with the exception that the preoxidation temperature is held constant at 285°C., rather than 270°C.

The following examples present representative comparisons between calculated A values and tensile strength values determined experimentally when employing the process of the present invention. The runs identified in the examples were selected at random from those previously reported in Table II. It should be understood that the invention is not limited to the specific details set forth in the examples.

EXAMPLE I

The pretreatment was conducted at 185°C. for 300 seconds and at a longitudinal shrinkage of 13.6 per cent, the preoxidation for 158 minutes at 270°C., and the carbonization/graphitization for 48 seconds at 2900° ±50°C. while under a longitudinal tension of 0.09 grams per denier. The calculated A value was −0.7. The single filament tensile strength determined experimentally was 414 thousand psi.

EXAMPLE II

The pretreatment was conducted at 185°C. for 400 seconds and at a longitudinal shrinkage of 10.6 per cent, the preoxidation for 160 minutes at 285°C., and the carbonization/graphitization for 48 seconds at 2900° ±50°C. while under a longitudinal tension of 0.16 grams per denier. The calculated A value was 36. The single filament tensile strength determined experimentally was 335 thousand psi.

EXAMPLE III

The pretreatment was conducted at 185°C. for 400 seconds and at a longitudinal shrinkage of 13.6 per cent, the preoxidation for 158 minutes at 285°C., and the carbonization/graphitization for 48 seconds at 2900° ±50°C. while under a longitudinal tension of 0.47 grams per denier. The calculated A value was 64. The single filament tensile strength determined experimentally was 332 thousand psi.

EXAMPLE IV

The pretreatment was conducted at 185°C. for 400 seconds and at a longitudinal shrinkage of 10.6 per cent, the preoxidation for 158 minutes at 270°C., and the carbonization/graphitization for 16 seconds at 2900° ±50°C. while under a longitudinal tension of 0.40 grams per denier. The calculated A value was −33. The single filament tensile strength determined experimentally was 412 thousand psi.

Although the invention has been described with preferred embodiments, it is to be understood that variations and modifications may be resorted to as will be apparent to those skilled in the art. Such variations are to be considered within the purview and scope of the claims appended hereto.

We claim:

1. An improved process for the conversion of a drawn acrylic fibrous material having an inherent tendency to shrink in length when heated at about 170° to 220°C. selected from the group consisting of an acrylonitrile homopolymer and acrylonitrile copolymers which contain at least about 95 mol per cent of acrylonitrile units and up to about 5 mol per cent of one or more monovinyl units copolymerized therewith selected from the group consisting of styrene, methyl acrylate, methyl methacrylate, vinyl acetate, vinyl chloride, vinylidene chloride, and vinyl pyridine to a high strength graphitic fibrous material comprising:

a. continuously passing a continuous length of said acrylic fibrous material for a residence time of about 90 to 900 seconds through a pretreatment heating zone provided with a gaseous atmosphere consisting essentially of an inert gas or air at a temperature of about 170° to 220°C. while under a longitudinal tension sufficient to permit up to about a 20 per cent reduction in length brought about through shrinkage wherein less than a 1 per cent increase in bound oxygen content takes place, b. continuously withdrawing said continuous length of the resulting pretreated fibrous material from said heating zone, c. continuously passing said resulting continuous length of pretreated fibrous material for a residence time of about 90 to 210 minutes through a preoxidation heating zone provided with an oxygen-containing atmosphere at a temperature of about 260° to 290°C. to produce a preoxidized fibrous material which retains essentially the same fibrous configuration as the starting material, is capable of undergoing carbonization, is black in appearance, and is non-burning when subjected to an ordinary match flame, and d. continuously passing a continuous length of said resulting preoxidized fibrous material while under a longitudinal tension of about 0.3 to 0.5 grams per denier through a carbonization/graphitization heating zone provided with an inert atmosphere and a temperature gradient in which said fibrous material is raised within a period of about 20 to about 300 seconds from about 800°C. to a temperature of about 1600° C. to form a continuous length of carbonized fibrous material, and in which said carbonized fibrous material is subsequently raised from 1600°C. to a temperature within the range of about 2400° to about 3100°C. within a period of about 2 to 300 seconds where it is maintained for about 10 seconds to about 200 seconds to form a continuous length of graphitic fibrous material; with said preoxidized fibrous material being supplied to said carbonization/graphitization heating zone in an anhydrous form;

said steps (a) and (c) being conducted in accordance with the formula:

$$A = 3X_2(12X_2 + 8X_3 + 7X_4) + 17X_3 + 10X_4,$$

where $$X_2 = \frac{\text{Residence Time in Preoxidation Zone in Minutes-137}}{33}$$

$$X_3 = \frac{\text{Temperature of Preoxidation Zone in °C. - 277.5}}{7.5}$$

$$X_4 = \frac{\text{Per Cent Shrinkage in Pretreatment Zone - 12,}}{2.2}$$

and where A is equal to or less than 111.

2. A process according to claim 1 wherein said acrylic fibrous material is an acrylonitrile homopolymer.

3. A process according to claim 1 wherein said pretreatment heating zone is provided with said gaseous atmosphere at a temperature of about 185° to 220°C. and said continuous length of acrylic fibrous material is under a longitudinal tension sufficient to permit a reduction in length of about 5 to 15 per cent brought about through shrinkage while passing through said pretreatment heating zone.

4. A process according to claim 3 wherein said gaseous atmosphere of said pretreatment heating zone is air.

5. A process according to claim 1 wherein said oxygen-containing atmosphere of said preoxidation heating zone is air.

6. A process according to claim 1 wherein said continuous length of pretreated fibrous material is under a longitudinal tension whereby a constant length is maintained while passing through said preoxidation heating zone.

7. A process according to claim 1 wherein said inert atmosphere provided in said carbonization/graphitization heating zone is selected from the group consisting of nitrogen and argon.

8. A process according to claim 1 wherein said gaseous atmosphere of said pretreatment heating zone is provided at a temperature of about 185° to 220°C., and said temperature gradient of said carbonization/graphitization zone raises said fibrous material within about 45 to 300 seconds from about 800°C. to a temperature of about 1600°C.

9. A process according to claim 8 wherein said gaseous atmosphere of said pretreatment heating zone is provided at a temperature of about 190° to 220°C.

10. A process according to claim 1 wherein said continuous length of acrylic fibrous material is under a longitudinal tension sufficient to permit a reduction in length of about 5 to 15 per cent brought about through shrinkage while passing through said pretreatment heating zone and A is equal to or less than 61.

11. A process according to claim 1 wherein said continuous length of acrylic fibrous material is under a longitudinal tension sufficient to permit a reduction in length of about 5 to 15 per cent brought about through shrinkage while passing through said pretreatment heating zone and A is equal to or less than 11.

12. A process according to claim 1 wherein said continuous length of acrylic fibrous material is under a longitudinal tension sufficient to permit a reduction in length of about 5 to 15 per cent brought about through shrinkage while passing through said pretreatment heating zone and A is equal to or less than minus 39.

* * * * *